US008471186B2

(12) United States Patent
Wallis

(10) Patent No.: US 8,471,186 B2
(45) Date of Patent: Jun. 25, 2013

(54) MISSILE GUIDANCE SYSTEM

(75) Inventor: Graham Patrick Wallis, St. Albans (GB)
(73) Assignee: MBDA UK Limited, Hertfordshire (GB)

( * ) Notice: Subject to any disclaimer, the term of this patent is extended or adjusted under 35 U.S.C. 154(b) by 362 days.

(21) Appl. No.: 12/672,443
(22) PCT Filed: Jan. 8, 2010
(86) PCT No.: PCT/GB2010/050022
§ 371 (c)(1), (2), (4) Date: Apr. 7, 2010
(87) PCT Pub. No.: WO2010/079361
PCT Pub. Date: Jul. 15, 2010
(65) Prior Publication Data
US 2011/0084161 A1 Apr. 14, 2011
(30) Foreign Application Priority Data
Jan. 9, 2009 (EP) ..... 09250055
Jan. 9, 2009 (GB) ..... 0900418.5
(51) Int. Cl.
*F41G 7/20* (2006.01)
*F42B 15/01* (2006.01)
*F41G 7/00* (2006.01)
*F42B 15/00* (2006.01)
(52) U.S. Cl.
USPC ..... 244/3.15; 244/3.1; 244/3.11; 244/3.16; 244/3.19; 382/100; 382/103; 342/61; 342/62
(58) Field of Classification Search
USPC ..... 244/3.1–3.19; 382/100, 103; 342/61, 342/62, 25 R–25 F, 52, 58, 59, 60, 175, 176, 342/179, 195, 63–65; 701/1, 3, 14
See application file for complete search history.

(56) References Cited

U.S. PATENT DOCUMENTS

| | | | | |
|---|---|---|---|---|
| 3,338,534 | A * | 8/1967 | Girsberger | 244/3.14 |
| 3,557,304 | A * | 1/1971 | Rue et al. | 244/3.14 |
| 3,564,134 | A * | 2/1971 | Rue et al. | 244/3.14 |
| 3,567,163 | A * | 3/1971 | Kepp et al. | 244/3.14 |
| 3,725,576 | A * | 4/1973 | Crawford et al. | 244/3.16 |
| 3,778,007 | A * | 12/1973 | Kearney et al. | 244/3.14 |
| 3,876,308 | A * | 4/1975 | Alpers | 244/3.16 |
| 3,986,682 | A * | 10/1976 | Dryden | 244/3.17 |
| 4,220,296 | A | 9/1980 | Hesse | |
| 4,267,562 | A * | 5/1981 | Raimondi | 89/1.11 |
| 4,860,968 | A * | 8/1989 | Pinson | 244/3.12 |
| 5,114,227 | A | 5/1992 | Cleveland, Jr. | |
| 5,294,930 | A * | 3/1994 | Li | 244/3.12 |
| 5,379,966 | A | 1/1995 | Simeone et al. | |

(Continued)

OTHER PUBLICATIONS

European Search Report dated Dec. 11, 2009.

(Continued)

*Primary Examiner* — Bernarr Gregory
(74) *Attorney, Agent, or Firm* — Scully, Scott, Murphy & Presser PC

(57) ABSTRACT

In a CLOS missile guidance system, target and missile tracking data e.g. video image data are acquired on a UAV and transmitted to the missile where they are processed to provide guidance control data to the missile. Alternatively the video image data may be transmitted to a command station where the guidance control data is generated and transmitted to the missile, preferably via the UAV.

22 Claims, 4 Drawing Sheets

U.S. PATENT DOCUMENTS

| | | | | |
|---|---|---|---|---|
| 5,521,817 | A * | 5/1996 | Burdoin et al. | 244/3.14 |
| RE35,553 | E * | 7/1997 | Li | 244/3.12 |
| 5,782,429 | A * | 7/1998 | Mead | 244/3.11 |
| 5,855,339 | A * | 1/1999 | Mead et al. | 244/3.11 |
| 6,043,756 | A * | 3/2000 | Bateman et al. | 701/14 |
| 6,157,875 | A * | 12/2000 | Hedman et al. | 701/1 |
| 6,910,657 | B2 * | 6/2005 | Schneider | 244/3.11 |
| 7,032,858 | B2 * | 4/2006 | Williams | 244/3.15 |
| 7,040,570 | B2 * | 5/2006 | Sims et al. | 244/3.16 |
| 7,183,967 | B1 * | 2/2007 | Haendel et al. | 342/59 |
| 7,338,009 | B1 * | 3/2008 | Bobinchak et al. | 244/3.15 |
| 7,422,175 | B1 * | 9/2008 | Bobinchak et al. | 244/3.15 |
| 7,675,012 | B1 * | 3/2010 | Bobinchak et al. | 244/3.15 |
| 7,947,936 | B1 * | 5/2011 | Bobinchak et al. | 244/3.15 |
| 2002/0154293 | A1 | 10/2002 | Wells et al. | |

OTHER PUBLICATIONS

United Kingdom Search Report dated Jun. 3, 2009.

International Search Report and Written Opinion dated Apr. 26, 2010.

International Preliminary Report on Patentability together with the Written Opinion dated Jul. 29, 2011 from International Application No. PCT/GB2010/050022.

* cited by examiner

MISSILE GUIDANCE SYSTEM

This invention relates to missile guidance systems particularly but not exclusively to systems of the type known as "command to line of sight" (CLOS).

In a CLOS system, both a missile and its target are tracked. The missile is then commanded by means of a data link to manoeuvre until it is flying on or in a controlled relationship to the line of sight between the target and the target tracker. In some systems a single sensor is used to view both the target and the missile. In others, separate sensors are used.

In known CLOS systems, the tracking of the target and the missile are conducted at the viewing location which often also is the command location. Depending on the type of missile system, this may be a ground station, a ship, a manned aircraft or another airborne platform such as an unmanned aerial vehicle (UAV). The relative angular positions of target and missile are mensurated (measured), and multiplied by the estimated range from sensor to missile to estimate the linear position of the missile with respect to the sightline to the target. Guidance (maneuvering) commands are then computed in accordance with a suitable control algorithm and transmitted to the missile. This configuration has the advantage that the data sent to the missile are simple, and the resources required on board the missile to process and implement the data are small. This of course is important because the cost of the missile, being an expendable vehicle, has to be minimised.

We have concluded that (counter-intuitively) it can be advantageous to perform much more of the mensuration and computation onboard the missile, despite it being expendable. By reducing the processing activity at the viewing location, it is less onerous to make the equipment at that location compatible with the missile system. This is particularly so if the sensor data acquired at the viewing location (including implicit or explicit indication of missile and target position) is sent to the missile as video data in a standard format.

According to a first aspect, a method of guiding a missile to a target comprises: acquiring, via sensor means at a location remote from the missile, image data at least partially indicative of the relative positions of the missile and the target; transmitting the image data to the missile; utilising the image data on board the missile to generate control data for guiding the missile to the target; and controlling the missile in accordance with the control data to direct it to the target.

A second aspect of the invention provides a method of guiding a missile to a target comprising acquiring, via sensor means on an airborne platform other than the missile, image data at least partially indicative of the relative positions of the missile and the target; transmitting the image data to a location other than onboard the airborne platform, utilising the imaged data at that location to generate control data for guiding the missile to the target; and controlling the missile in accordance with the control data to direct it to the target.

In this aspect the image data may be transmitted to the missile and used to generate the control data on board the missile. The image data may be transmitted to the missile in a signal which is also transmitted to a command location.

Alternatively, the method may comprise receiving the image data at a location (e.g. a surface based or manned airborne command location) remote from the airborne platform, utilising the control data at said location to generate the control data and transmitting the control data to the missile. The control data may be transmitted to the missile via the airborne platform.

Preferred embodiments of the invention may comprise utilising the image data to mensurate the position of the missile relative to a line of sight from the sensor means to the target and generating the control data to direct the missile onto the said line of sight.

The image data may be an image including the missile and the target. Preferably the said image data is acquired in a single field of view of the sensor.

The method may include launching the missile from the airborne platform. Alternatively the missile may be launched from a third remote location, and be guided initially by other means into the field of view of the sensor.

The method may include sensing radiation from a rearwardly—radiating source on the missile. The radiation source may be an active source. The radiation may be code-modulated, and/or may be controlled in response to data acquired via the sensor.

In a third aspect, the invention provides a missile guidance system comprising: sensor means configured for acquiring, at a location remote from the missile, image data at least partially indicative of the relative positions of the missile and the target, and for transmitting the image data to the missile; and data processing means configured for installation on the missile for utilising the image data on board the missile to generate control data for guiding the missile to the target, In a fourth aspect, the invention provides a missile guidance system comprising: means, configured for installation on an airborne platform other than the missile, for acquiring image data at least partially indicative of the relative position of a missile and a target and for transmitting the image data from the airborne platform; data processing means configured for installation other than on the airborne platform for receiving the image data, for utilising it to generate control data for guiding the missile to the target.

in a fifth aspect, the invention provides a controller configured for installation in a missile and for use in the system as set forth above, the controller comprising: means for receiving from the airborne platform or other said location remote from the missile image data acquired at that location and indicative of the relative positions of the missile and a target; and data processing means for utilising the acquired data to generate control data for guiding the missile to the target.

The data processing means may be configured to mensurate the position of the missile relative to a line of sight from the sensor means to the target and to generate the control data to direct the missile on to the said line of sight.

The invention also provides a missile having a controller as set forth above and control means responsive to the control data for directing the missile to the target. The missile may have means for directing radiation, preferably code-modulated radiation, rearwardly from the missile.

The invention will be described merely by way of example with reference to the accompanying drawings, wherein FIG. 1 illustrates the principles of a CLOS system;

Figure 1:
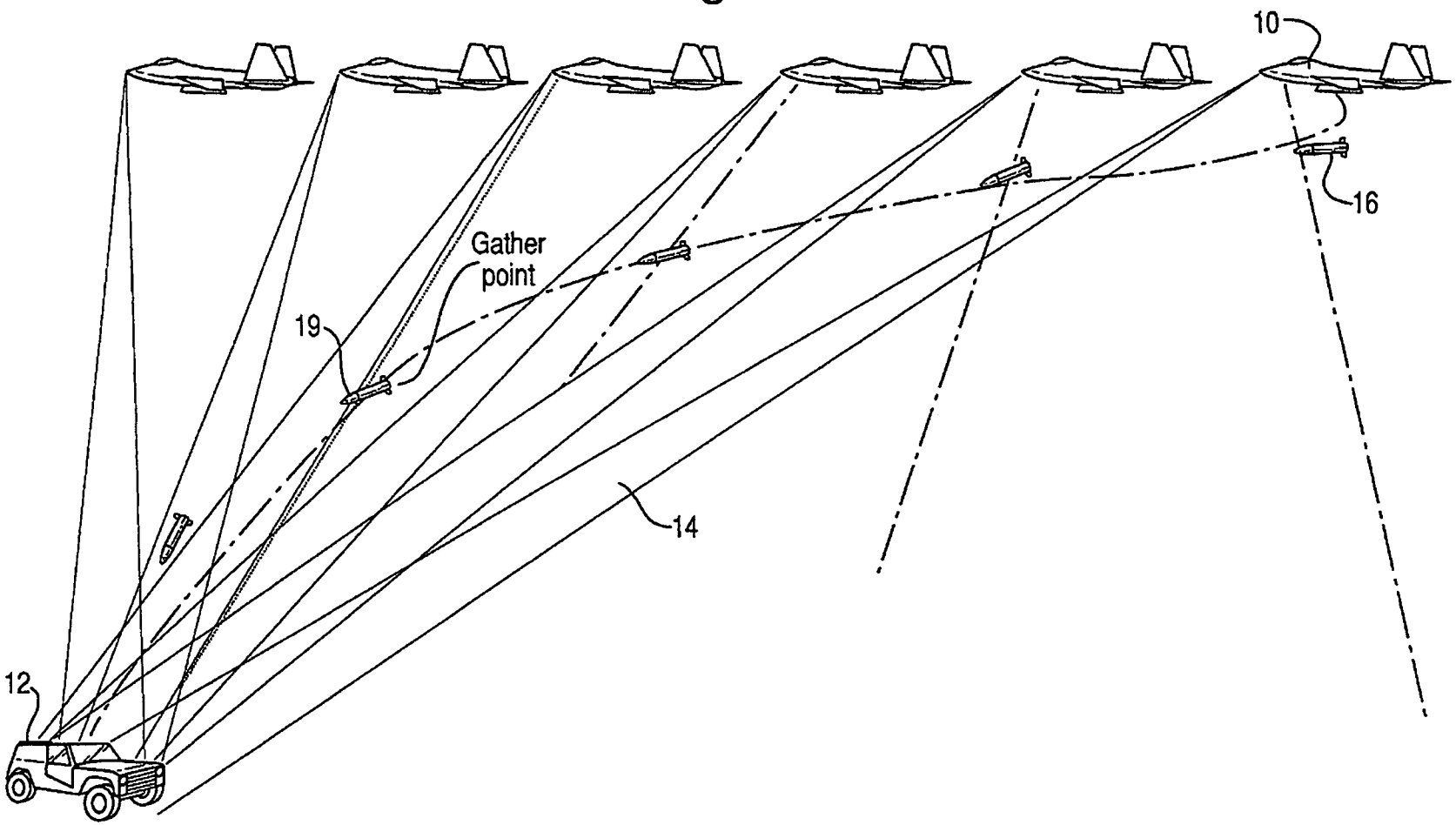

Referring to FIG. 1, in an example of command to line of sight guidance an aircraft 10 (here shown as a manned aircraft, but which could be another type of airborne platform e.g. a UAV) acquires a target 12 by means of a video, infrared or radar sensor which has a field of view 14. The aircraft 10 launches a missile, here a gliding or stand-off bomb 16 which proceeds along a trajectory 18 until it enters the field of view 14 of the aircraft's sensor at 19. The aircraft's weapons control computer receives the sensor data and determines the bearing of the missile relative to the line of sight to the target. Then, perhaps also having regard to the target range and some basic missile range data derived from its time of flight and assumed speed, it guides the missile on to the target by transmitting control data for the flight controls of the missile.

Figure 2:
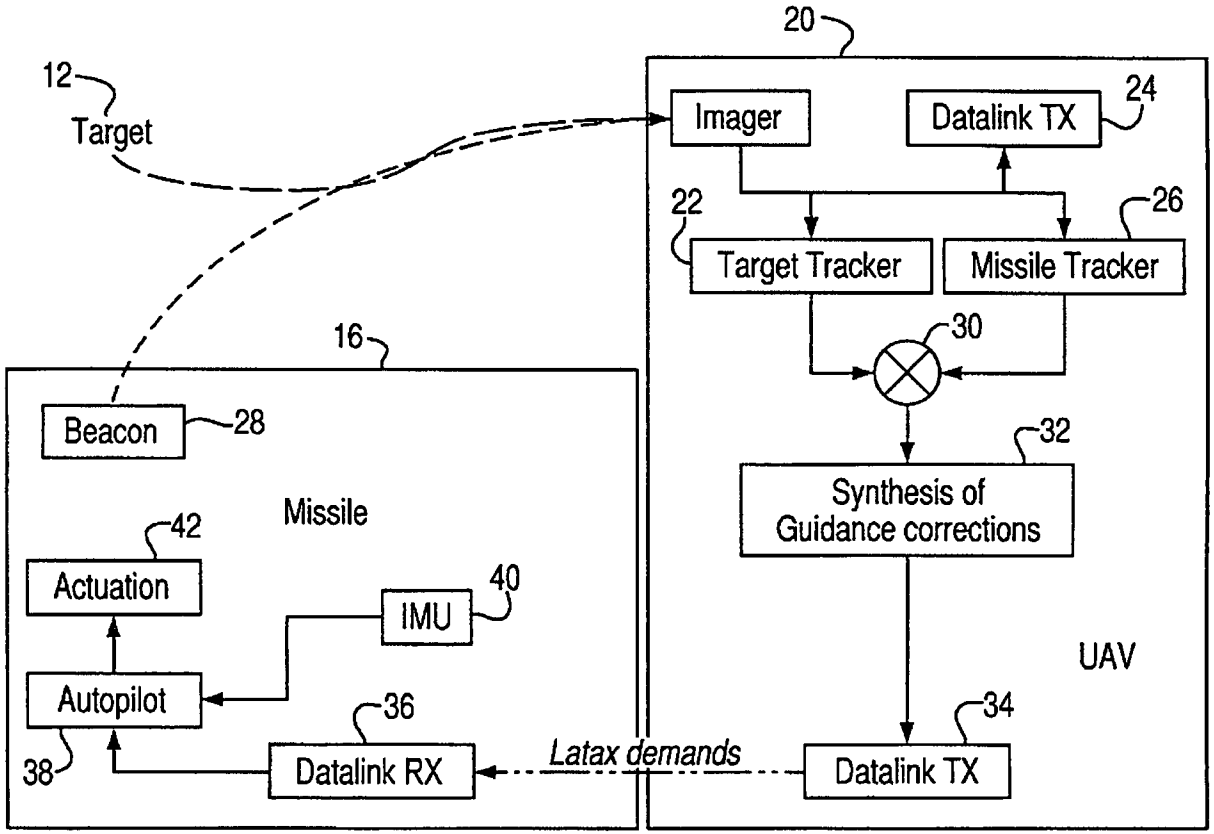
FIG. 2 shows diagrammatically the architecture of a CLOS system.

FIG. 2 shows the architecture of the missile control system used in FIG. 1. Here the airborne platform 10 is a UAV. Its sensor 20 is a video camera which acquires an image of the target 12 in its field of view and tracks it by means of a target tracker function 22 in its onboard computer. The UAV also sends the image via an operator data link 24 to a surface command station (e.g. a land vehicle or a ship). The UAV controller at the surface station assesses the target and if appropriate instructs the UAV via the data link to engage it. The UAV launches the missile which in due course enters the field of view of the sensor as described above, and is tracked by missile tracker function 26 in the onboard computer. A rearward facing marker 28 assists the tracker function 28 to acquire this missile. The target and missile tracking data are combined at 30 and further processed at 32 to provide control data (guidance corrections) for the missile. These data, in the form of lateral acceleration commands about the pitch and yaw axes of the missile, are transmitted to the missile via a command data link transmitter 34.

On board the missile 16, the control data are received in data link receiver 36 and passed to a controller (autopilot) 38, which also receives inputs from on-board inertial sensors (gyros, accelerometers) in an inertial measuring unit 40. The controller 38 commands appropriate movements to actuators 42 of the flight control surfaces of the bomb to guide it to its target.

In this known system, the functionality of the guidance chain is distributed between the UAV and the missile. The missile and the UAV may be designed and manufactured by the same company which has overall design authority for the system, and then this distribution of functions presents no real difficulties. However, where the missile and the platform carrying the sensor and tracker are the products of different design authorities, the development, integration and validation of the overall guidance loop becomes a complex problem of responsibilities. The difficulties increase if a single missile design is to be integrated with multiple platforms of differing origins. To create a modular system, the platform authorities all have to accommodate a common tracking/guidance module, and given the difficulties in reliable porting of algorithms from one host to another, the solution invariably becomes a dedicated processor module for each missile design.

An alternative and novel implementation, which is the subject of one embodiment of this invention, is for the two tracking functions (of both missile and target) to be hosted onboard the missile, together with the computation of manoeuvre commands and the autopilot. It can be applied especially where the missile and target are both viewed by a single imaging sensor. It requires the image to be transmitted to the missile, rather than the manoeuvre commands.

The distinction of this implementation is that all the algorithmic processing required for missile guidance is hosted on the missile. In practical terms the advantage comes from a clarification of responsibilities and a consequent reduction in the integration difficulties. The missile becomes a self contained module, its guidance requiring only an image sequence, and the platform is simplified, becoming merely a provider of the images.

Figure 3:
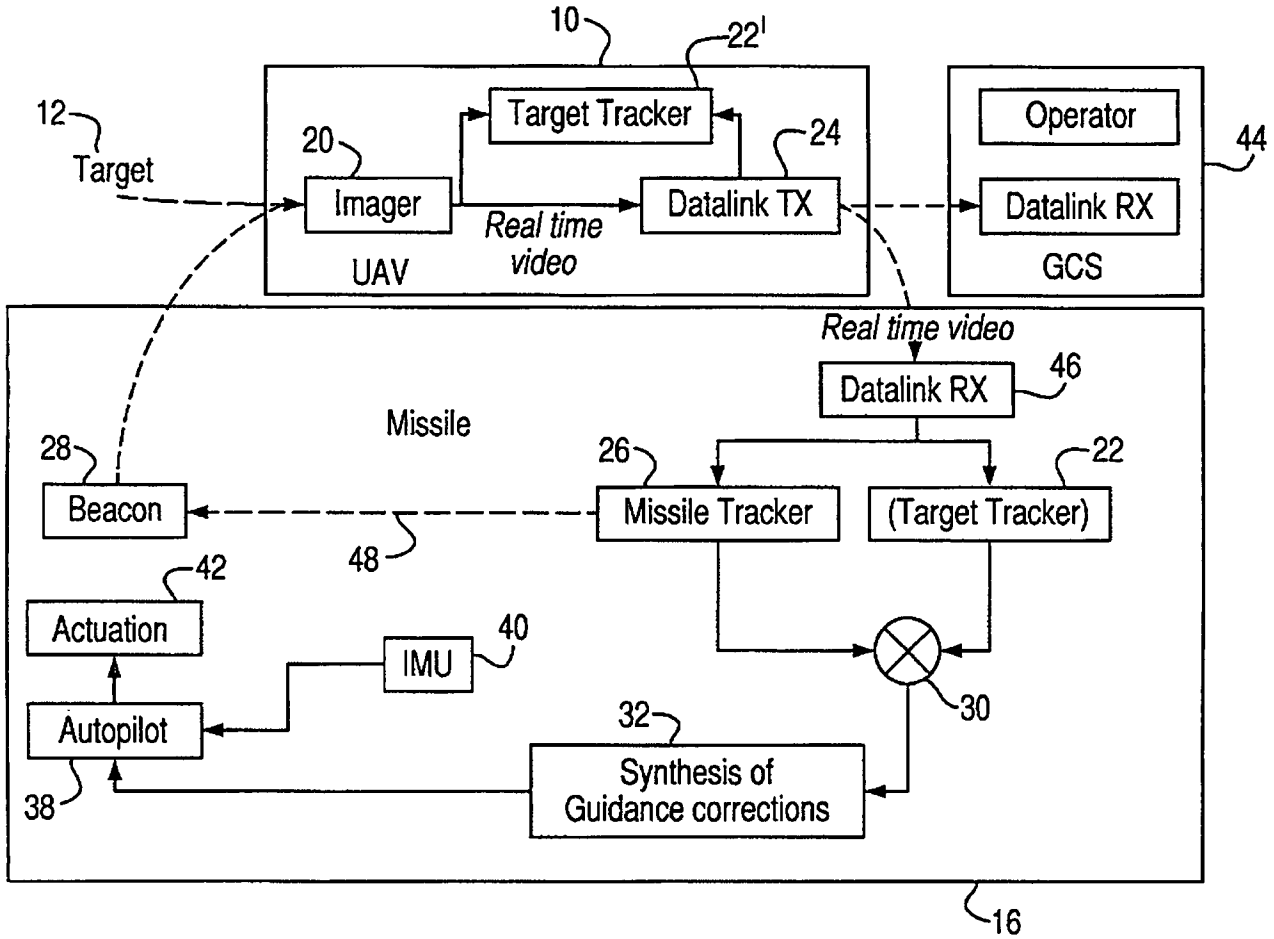
FIG. 3 shows an embodiment of the invention.

The novel architecture described is illustrated in FIG. 3; features already described with reference to FIGS. 1 and 2 carry the same reference numerals as in those figures. In this embodiment, the imaging sensor 20 on the UAV acquires the target and sends real-time image data to the command station 44 as before, via data link transmitter 2. The transmitted signal is received also by a data link receiver 46 in the missile, which supplies it to an on-board computer running the target tracker and missile tracker algorithms 22, 26 hitherto implemented on the UAV. The target and missile tracking data are combined at 30 and further processed by the missile's computer to provide control data at 32 which commands the autopilot 38, all as previously described with reference to FIG. 2 except that all of the functions are performed on-board the missile.

A target tracker 22' is still provided on the UAV so that the operator can require the UAV to track a nominated target before launch of the missile, and maintain the sensor field of view on the target after launch. This tracker however need not be customised to suit the particular missile or missiles covered by the UAV. That said, a more sophisticated approach would be for the UAV to utilise (alternatively or in addition to the tracker 22') a clone of the missile's tracker 22 before launch, and to port its output to the operator 44 via the datalink 24. This will give the operator greater insight into the engagement as it proceeds.

Alternatively, the target tracker 22' on the UAV may impose on the image before transmission a cursor or crosshair, centred on the tracked target. The target acquisition task of the missile processor is then limited to the extraction of the cursor, Alternatively, in the case where the datalink is digital, the pixel coordinates of the target according to the tracker 22' may be included in the transmissions, and the missile does not need an explicit target tracker 22.

The transmission of real-time video image data requires significant bandwidth, but can be achieved using known compression techniques. The signal transmitted by data link transmitter 24 is relatively powerful, in order to reach the command station 44 when the UAV is at its extreme range. The missile launched from the UAV will be relatively much closer to the UAV, and so the data link receiver 46 on the missile can be of much lower sensitivity than the one at the command station.

A rearward-looking directional antenna on the missile is provided to receive the datalink signal. This configuration may give some resistance to jamming from jamming sources ahead of the missile.

The rearwardly radiating marker 28 is chosen according to the electromagnetic band of the sensor 20. It may be active (e.g. a flare, or other radiation emitting beacon, or the residual heat of a rocket motor if the missile is powered).

The use of a beacon makes the system vulnerable to countermeasures, where the signal from the beacon might be overwhelmed by a more intense jamming source. To reduce this vulnerability, the beacon 28 may be a pulsed beacon, allowing continuous jammers to be filtered out using ac coupled filters. This of course can still be mimicked in such a way as to mislead the tracking system, by a pulsed jamming system. The best counter-countermeasure (CCM) is for the beacon to be coded in such a way that the jammer cannot mimic. The availability of computing power on-board the missile enables the beacon 28 to be controlled in real time via a feedback loop 48. The coding of the beacon can thus be adjusted in response to the missile tracking function 26 under closed loop control, allowing adaptation to defeat an interfering countermeasure.

The closed loop control of the beacon 28 also allows adaptation to the frame timing (typically 30 Hz) of the sensor 20. If the sensor cannot immediately detect the beacon, the missile tracker function 26 in the missile computer progressively shifts the phase of the beacon pulses until the sensor detects the beacon and the tracker locks on to it, in a manner similar to that used to synchronise GPS systems.

If the UAV is armed with several missiles, each missile beacon can be given a different code. Then the UAV can engage several targets simultaneously without requiring additional functionality on the UAV, provided all the targets are within the field of view of the sensor 20.

Figure 4:
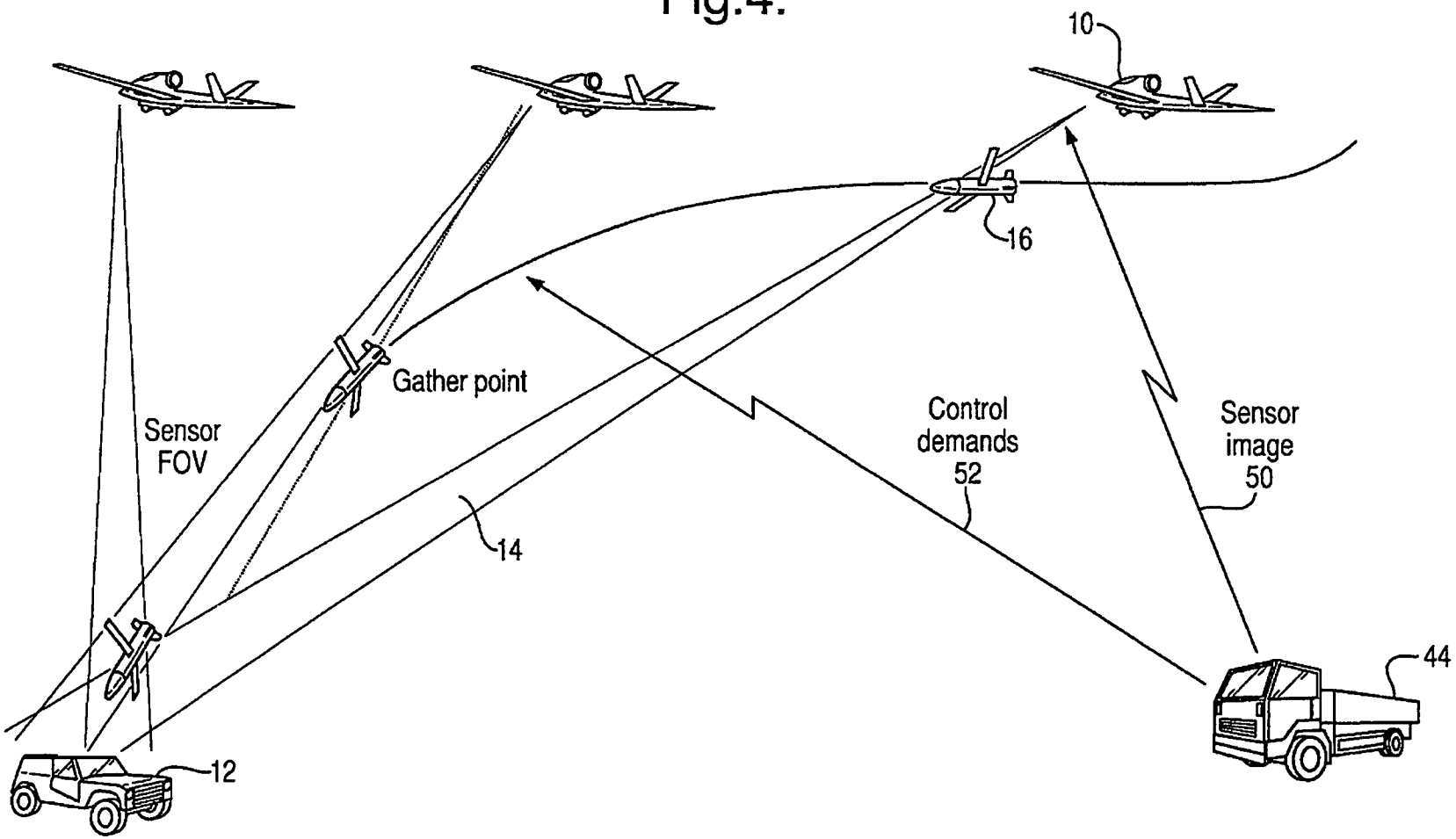
FIG. 4 shows another embodiment of the invention.

FIG. 4 shows another embodiment of the invention. Whilst this embodiment does not integrate all guidance functions on-board the missile, it still results in the UAV being relieved of guidance responsibilities. The UAV thus remains a relatively simple platform requires little modification to add the missile capability Thus in FIG. 4, the UAV 10 transmits relative positional (video) data 50 to the command location 44, which in this embodiment houses the target tracker 22, missile tracker 26 and control data synthesising functions 30, 32. The control data 52 is transmitted back to the UAV 10 via the uplink between data link terminals 24, 44 and is then relayed via transmitter and receiver 34, 36 (FIG. 2) to the missile 16, to guide it to the target. Alternatively, in some circumstances, e.g. if the command station is itself airborne, the control data 52 may be transmitted directly to the missile rather than via the UAV. In either case the beacon of the missile is controlled remotely from the command location, but functionally in the same way as described with reference to FIG. 3.

The invention also includes any novel features or combinations of features herein disclosed, whether or not specifically claimed. The abstract of the disclosure is repeated here as part of the specification.

In a CLOS missile guidance system, target and missile tracking data e.g. video image data are acquired on a UAV and transmitted to the missile where they are processed to provide guidance control data to the missile. Alternatively the video image data may be transmitted to a command station where the guidance control data is generated and transmitted to the missile, preferably via the UAV.

The invention claimed is:

1. A method of guiding a launched missile to a target comprising: acquiring, via sensor means at a sensor location remote from the missile, image data indicative of the relative positions of the launched missile and the target; transmitting the image data to the missile; utilising the image data on board the missile to generate control data for guiding the missile to the target, and controlling the launched missile in accordance with the control data to guide it to the target.

2. A method as in claim 1 wherein the image data is transmitted to the missile in a signal which is also transmitted to a command location.

3. A method of guiding a launched missile to a target comprising: acquiring via sensor means on an airborne platform other than the missile, image data indicative of the relative positions of the launched missile and the target; transmitting the image data to a location other than onboard the airborne platform, utilising the image data at that other location to generate control data for guiding the missile to the target; and controlling the missile in accordance with the control data to guide it to the target.

4. A method as in claim 1 or 3, comprising utilising the image data to mensurate the position of the missile relative to a line of sight from the sensor means to the target and generating the control data to guide the missile on to the said line of sight.

5. A method as in claim 1 or 3, wherein the image data is an image including the launched missile and the target.

6. A method as in claim 1 or 3, comprising sensing radiation from a rearwardly-facing marker on the missile.

7. A method as in claim 6 wherein the marker is a radiation-emitting source, the method including controlling the source in response to data acquired via the sensor means.

8. A method as in claim 1 or 3, wherein the sensor location or the airborne platform is an unmanned aerial vehicle.

9. A method as in claim 3 wherein said other location is on board the missile.

10. A method as in claim 9, comprising launching the missile from the airborne platform.

11. A method as in claim 3 wherein said other location is a command location, the method further comprising receiving the image data at the command location, utilising the image data to generate the control data at the command location, and transmitting the control data to the launched missile.

12. A method as in claim 11 comprising transmitting the control data to the missile via the airborne platform.

13. A missile guidance system comprising: sensor means configured for acquiring image data at a sensor location remote from a launched missile, the image data being indicative of the relative positions of the launched missile and a target, and for transmitting the image data to the launched missile; and data processing means configured for utilising the image data on board the missile to generate control data for guiding the missile to the target.

14. A missile guidance system comprising: sensor means, configured for acquiring image data at a sensor location on an airborne platform other than a missile, the image data being indicative of the relative positions of the missile when launched, and a target, and for transmitting the image data from the airborne platform; and data processing means configured for receiving the image data and utilising the image data to generate control data for guiding the missile to the target.

15. A system as in claim 13 or 14, wherein the data processing means is configured to mensurate the position of the launched missile relative to a line of sight from the sensor means to the target and to generate the control data to guide the missile on to the said line of sight.

16. A system as in claim 13 or 14 wherein the image data is an image including the launched missile and the target in a single field of view.

17. A controller configured for use in a missile guidance system, the controller comprising: means for receiving, from a location remote from a launched missile, image data acquired at that location indicative of the relative positions of the launched missile and a target; and data processing means for utilising the image data to generate control data for guiding the launched missile to the target.

18. A controller as in claim 17, further comprising the controller having a missile and a control means responsive to the control data for guiding the missile to the target.

19. A controller as in claim 18, wherein the missile includes a rearwardly visible marker.

20. A controller as in claim 19 wherein the marker is a radiation-emitting source, and the missile further includes means for controlling the source in response to data acquired from the sensor means.

21. A controller as in claim 17, wherein the data processing means is configured to mensurate the position of the launched missile relative to a line of sight from the sensor means to the target and to generate the control data to guide the missile on to the said line of sight.

22. A controller as in claim 17 wherein the image data is an image including the missile and the target in a single field of view.

* * * * *